US005594463A

United States Patent [19]

Sakamoto

[11] Patent Number: 5,594,463

[45] Date of Patent: Jan. 14, 1997

[54] DRIVING CIRCUIT FOR DISPLAY APPARATUS, AND METHOD OF DRIVING DISPLAY APPARATUS

[75] Inventor: Mitsunao Sakamoto, Tsurugashima, Japan

[73] Assignee: Pioneer Electronic Corporation, Tokyo-to, Japan

[21] Appl. No.: 273,816

[22] Filed: Jul. 12, 1994

[30] Foreign Application Priority Data

Jul. 19, 1993 [JP] Japan ..... 5-178325
Jul. 19, 1993 [JP] Japan ..... 5-178326

[51] Int. Cl.[6] ..... G09G 3/30

[52] U.S. Cl. ..... 345/76; 345/78

[58] Field of Search ..... 345/36, 37, 76, 345/77, 78, 101

[56] References Cited

U.S. PATENT DOCUMENTS 4,736,137 4/1988 Ohwada et al. ..... 345/76
4,983,885 1/1991 Fujioka et al. ..... 345/78
5,066,945 11/1991 Kanno et al. ..... 345/101
5,093,654 3/1992 Swift et al. ..... 345/76
5,311,169 5/1994 Inada et al. ..... 345/77
5,315,695 5/1994 Saito et al. ..... 345/77
5,451,978 9/1995 Harju ..... 345/78

*Primary Examiner*—Steven Saras
*Attorney, Agent, or Firm*— Young & Thompson

[57] ABSTRACT

A display apparatus has a display panel, which is provided with a plurality of scanning electrodes and a plurality of signal electrodes arranged in a matrix shape, and a plurality of EL elements connected to the scanning electrodes and the signal electrodes at intersections thereof. A driving circuit for the display apparatus is provided with: a driving device for supplying a constant current driving signal to the signal electrodes in correspondence with an input signal, to drive the display panel; a detection device for detecting a voltage drop in a forward direction of the EL element, and outputting a detection signal which indicates the detected voltage drop; and a control device for controlling voltage, which is supplied to the driving device, to have a predetermined voltage value in correspondence with the detection signal from the detection device.

16 Claims, 13 Drawing Sheets

X DRIVER

Y DRIVER

FPUL

FCLK

ELECTRODE K0

ELECTRODE K1

ELECTRODE K2
1 HORIZONTAL SYNCHRONIZATION PERIOD
VERTICAL SYNCHRONIZATION PERIOD
K2 LIGHTING
K1 LIGHTING
K0 LIGHTING

DRIVING CIRCUIT FOR DISPLAY APPARATUS, AND METHOD OF DRIVING DISPLAY APPARATUS

BACKGROUND OF THE INVENTION

1. Field of the Invention

The present invention generally relates to a driving circuit for a display apparatus, and a method of driving the display apparatus.

2. Description of the Related Art

There is a display apparatus, in which a plurality of scanning electrodes and a plurality of signal electrodes are arranged in a matrix shape, and an EL (Electroluminescence) element is connected to one scanning electrode and one signal electrode at each intersection of the scanning electrode and the signal electrode. By supplying a constant current driving signal to a desired signal electrode with respect to one common scanning electrode, the corresponding EL element is set in a lighting condition.

In this type of display apparatus, the EL element is degraded in its ability after it is used for a long time, so that a voltage drop Vf in the forward direction becomes large, and that the characteristic of luminance versus electric current, is also degraded. In this manner, in a constant current driving method, as the EL element is degraded in its ability, the luminance of the EL element is also gradually degraded.

Therefore, countermeasures may be proposed to prevent the voltage drop Vf in the forward direction.

Firstly, in this type of display apparatus, the voltage to be supplied to the driving device of the display apparatus, may be set high in advance so as to deal with the expected increase of the voltage drop Vf in the forward direction of the EL element. However, if the voltage to be supplied to the driving device is set high in advance in this manner, the high voltage is supplied to the driving device even in an initial condition where the ability of the EL element is not degraded. As a result, the electric power consumed by the transistors in the driving device is increased, so that there arises a waste of energy consumption.

Secondly, the current supplied from the driving device for the display apparatus, may be set high in advance so as to deal with the expected increase of the voltage drop Vf in the forward direction of the EL element. However, if this current supplied from the driving device is set high in advance in this manner, the high current is supplied from the driving device even in an initial condition where the ability of the EL elements is not degraded. As a result, the electric power consumed by transistors in the driving device is increased, so that there arises a waste of energy consumption, too.

SUMMARY OF THE INVENTION

It is therefore an object of the present invention to provide a driving circuit for a display apparatus and a method of driving the display apparatus, which can obtain an appropriate lighting condition of the EL element after it is used for a long time, and, at the same time, which can save the consumption energy even in the initial condition of the usage of the EL element.

The above object of the present invention can be achieved by a first driving circuit for a display apparatus having a display panel. The display panel is provided with a plurality of scanning electrodes and a plurality of signal electrodes arranged in a matrix shape, and a plurality of EL elements connected to the scanning electrodes and the signal electrodes at intersections thereof. The first driving circuit is provided with: a driving device for supplying a constant current driving signal to the signal electrodes in correspondence with an input signal, to drive the display panel; a detection device for detecting a voltage drop in a forward direction of the EL element, and outputting a detection signal which indicates the detected voltage drop; and a control device for controlling voltage, which is supplied to the driving device, to have a predetermined voltage value in correspondence with the detection signal from the detection device.

When the EL element is used for a long time, the ability of the EL element is gradually degraded, so that the voltage drop Vf in the forward direction of the EL element, is increased. Thus, the voltage supplied to the driving device runs short. As a result, there arises a possibility that the driving device does not function normally. Therefore, in the first driving circuit of the present invention, the voltage drop Vf of the EL element is detected by the detecting device for detecting the voltage of the signal electrode connected to the EL element from the driving device. Here, if the detected voltage drop Vf is small, the voltage to be supplied to the driving device is set low. Thus, since the voltage having the minimum limit value of the necessary voltage to function the driving device, is supplied to the driving device, the energy consumption can be reduced.

On the other hand, if the voltage drop Vf of the EL element becomes large after extended usage of the EL element, this large voltage drop Vf is detected by the detecting device. Then, the voltage supplied to the driving device is increased, so that the driving device can perform the normal constant current operation.

Consequently, an appropriate lighting condition of the EL element can be achieved after it is used for a long time, and, at the same time, the energy can be saved even in the initial condition of the usage of the EL element, according to the first driving circuit of the present invention.

The above object of the present invention can be also achieved by a second driving circuit for a display apparatus having a display panel. The display panel is provided with a plurality of scanning electrodes and a plurality of signal electrodes arranged in a matrix shape, and a plurality of EL elements connected to the scanning electrodes and the signal electrodes at intersections thereof. The second driving circuit is provided with: a driving device for supplying a constant current driving signal to the signal electrodes in correspondence with an input signal, to drive the display panel; a detection device for detecting a voltage drop in a forward direction of the EL element, and outputting a detection signal which indicates the detected voltage drop; and a control device for controlling the constant current driving signal, which is supplied from the driving device, to have a current value which keeps a luminance of the EL element constant in correspondence with the detection signal from the detection device.

When the EL element is used for a long time, the voltage drop Vf of the EL element is increased, and, at the same time, the characteristic of luminance versus current of the EL element, is also degraded. Thus, the luminance of the EL element is decreased. Therefore, in the second driving circuit of the present invention, the voltage drop Vf of the EL element is detected by the detecting device for detecting the voltage of the signal electrode connected to the EL element from the driving device. Here, if the detected voltage drop Vf is small, the current supplied from the driving device is set low. Thus, since the current having the minimum limit value of the necessary current range to drive the EL element, is supplied from the driving device, the energy consumption can be reduced.

On the other hand, if the voltage drop Vf of the EL element becomes large and the luminance of the EL element is decreased after the long time usage of the EL element, this large voltage drop Vf is detected by the detecting device. Then, the current supplied from the driving device is increased, so that the luminance of the EL element is kept constant.

Consequently, the EL element can maintain the constant luminance until the end of its life, according to the second driving circuit of the present invention.

The above object of the present invention can be also achieved by a first method of driving the above mentioned display apparatus having the display panel. The first method includes the steps of: supplying a constant current driving signal to the signal electrodes in correspondence with an input signal, to drive the display panel by a driving device; detecting a voltage drop in a forward direction of the EL element, and outputting a detection signal which indicates the detected voltage drop; and controlling voltage, which is supplied to the driving device, to have a predetermined voltage value in correspondence with the detection signal.

According to the first method of the present invention, an appropriate lighting condition of the EL element can be achieved after it is used for a long time, and, at the same time, the energy can be saved even in the initial condition of the usage of the EL element, in the same manner as in the first driving circuit of the present invention.

The above mentioned object of the present invention can be also achieved by a second method of driving the above mentioned display apparatus having the display panel. The second method includes the steps of: supplying a constant current driving signal to the signal electrodes in correspondence with an input signal, to drive the display panel; detecting a voltage drop in a forward direction of the EL element, and outputting a detection signal which indicates the detected voltage drop; and controlling the constant current driving signal to have a current value which keeps a luminance of the EL element constant in correspondence with the detection signal.

According to the second method of the present invention, the EL element can maintain the constant luminance until the end of its life, in the same manner as in the second driving circuit of the present invention.

The nature, utility, and further features of this invention will be more clearly apparent from the following detailed description with respect to preferred embodiments of the invention when read in conjunction with the accompanying drawings briefly described below.

DETAILED DESCRIPTION OF THE PREFERRED EMBODIMENTS

Referring to the accompanying drawings, an embodiment of the present invention will be now explained.

First Embodiment

Figure 1:
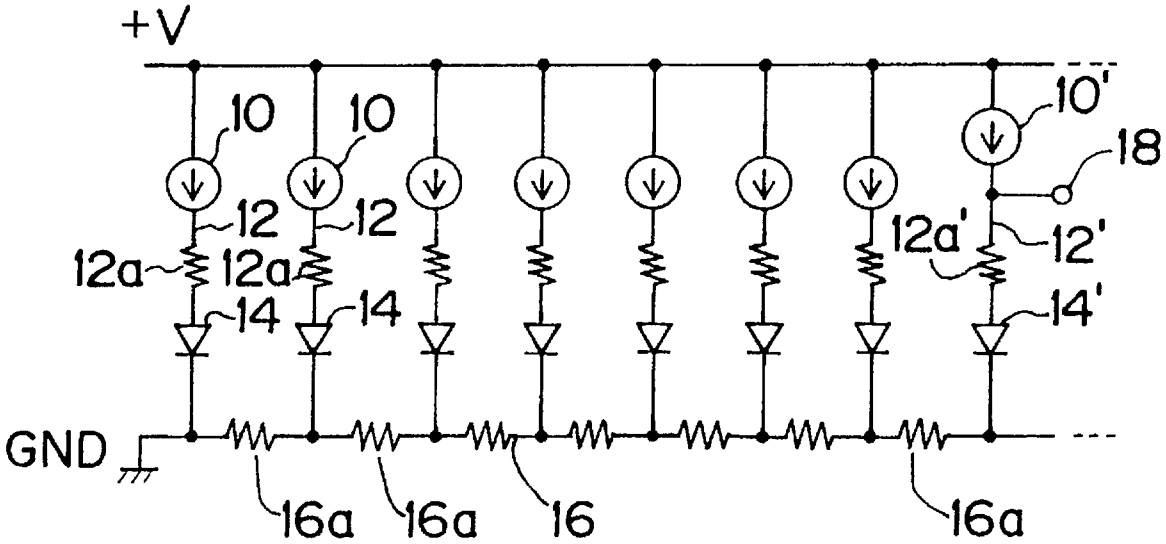
FIG. 1 is a circuit diagram of a driving circuit for a display apparatus, as one embodiment of the present invention.

FIG. 1 shows a driving circuit for a display apparatus of simple matrix type (i.e. constant current driving type), as one embodiment of the present invention.

In FIG. 1, source voltage (+V) is supplied to EL elements 14 through constant current sources 10 and signal electrodes 12 of the driving device. The EL elements 14 are connected to a ground GND through a scanning electrode 16. Anodes of the EL elements 14 are respectively connected to the signal electrodes 12. Cathodes of the EL elements 14 to 14' are respectively connected to the scanning electrode 16. Reference numeral **12*a* represent a resistance of the signal electrodes 12, and 16*a* represents a resistance of the scanning electrode 16**.

In the above explained construction of the driving circuit, when the signal electrode 12' (i.e. the signal electrode at the right edge in FIG. 1) and the scanning electrode 16, which drive the central portion of the picture plane of the display apparatus, are selected, and all of the EL elements 14, which are connected to the scanning electrode 16, are turned ON, the voltage difference between the signal electrode 12' and the scanning electrode 16 becomes the largest, among the signal electrodes 12 and 12' with respect to the selected scanning electrode 16. The reason why the voltage reference of the signal electrode 12', which drives the central portion of the picture plane, is the largest with respect to the selected scanning electrode 16, is that the length of the scanning electrode 16 from the EL element 14', which is connected to the signal electrode 12', to the ground GND is the longest i.e. the resistances **16*a* of the scanning electrode 16 to the GND is the largest, as compared with other signal electrodes 12**.

As described above, the voltage of the signal electrode 12' is increased to the largest extent. Thus, it becomes possible to appropriately set the source voltage (+V), by detecting the voltage difference of the signal electrode 12' at a detection terminal 18, on the basis of the detected voltage. Namely, as the voltage drop Vf of the EL element 14' is increased by the long time usage of the EL element 14', the source voltage (+V) is increased on the basis of the detected voltage at the detection terminal 18, so that a constant current source 10' can perform the normal constant current operation.

In FIG. 1, the voltage of the signal electrode 12' to drive the central portion of the picture plane, is detected at the detection terminal 18. However, the detection point is not limited in the central portion of the picture plane in this manner, but the detection point can be set at any other picture element of the picture plane. In this case, the detected voltage is compensated by taking into consideration the voltage drop in the electric lines etc., and the source voltage (+V) for the constant current sources 10 is set such that the constant current sources 10 can normally function.

Figure 2:
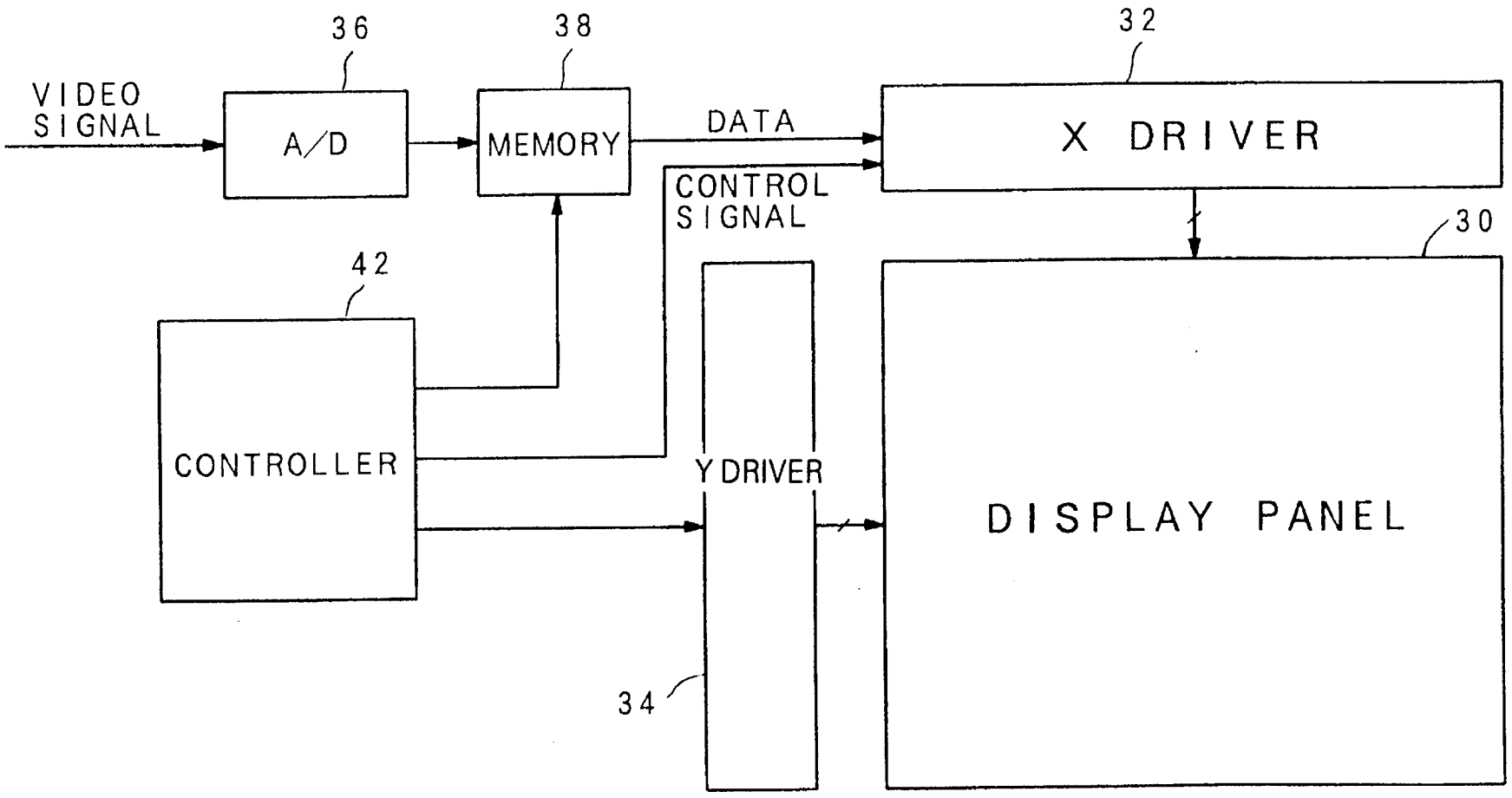
FIG. 2 is a block diagram of the display apparatus including the driving circuit of the present embodiment.

FIG. 2 shows a display apparatus as another embodiment of the present invention, to which the above explained driving circuit according to the present invention is installed.

In FIG. 2, the display apparatus is provided with: a display panel 30, a X driver 32, a Y driver 34, an A/D (Analog to Digital) convertor 36, a memory 38, and a controller 42.

The display panel 30 is driven by the X driver 32 and the Y driver 34. The video signal is supplied to the memory 38 through the A/D convertor 36. The data from the memory 38 is supplied to the X driver 32. The controller 42 controls the X driver 32, the Y driver 34, and the memory 38.

Figure 3:
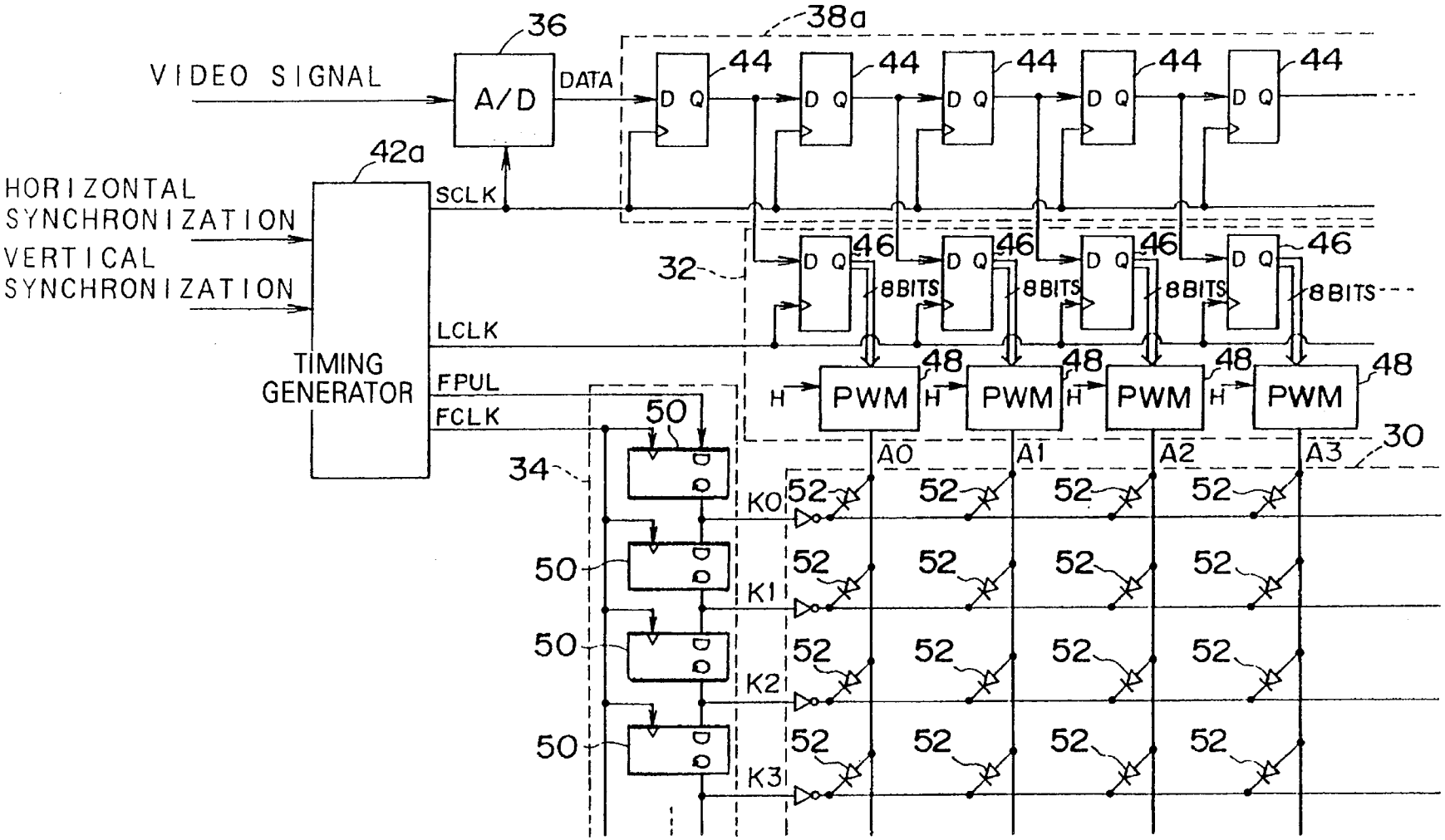
FIG. 3 is a circuit diagram of the display apparatus including the driving circuit of the present embodiment.
Figure 4A:
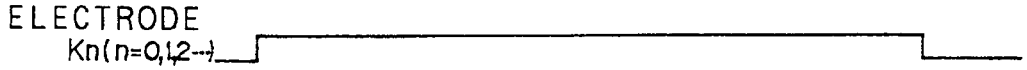
FIGS. 4A–4G are timing charts of a X driver and FIG. 4H–4L are timing charts of a Y driver in the present embodiment.
Figure 4B:
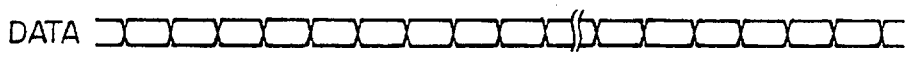
Figure 4C:
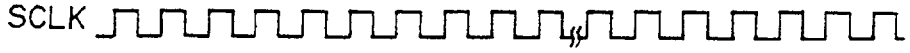
Figure 4D:
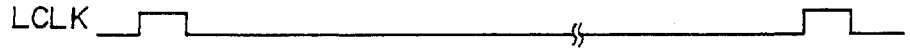
Figure 4E:
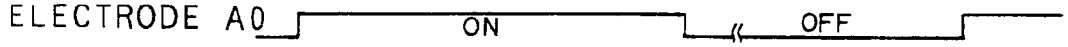
Figure 4F:
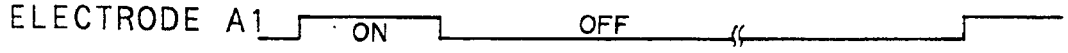
Figure 4G:
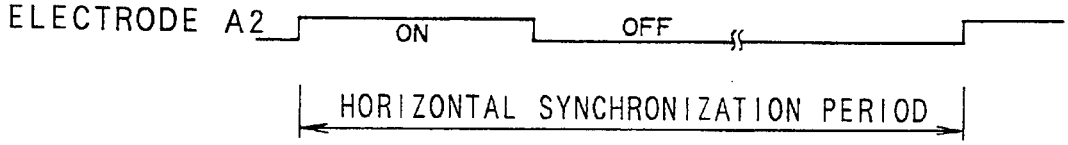
Figures 4H, 4I, 4J, 4K, 4L:
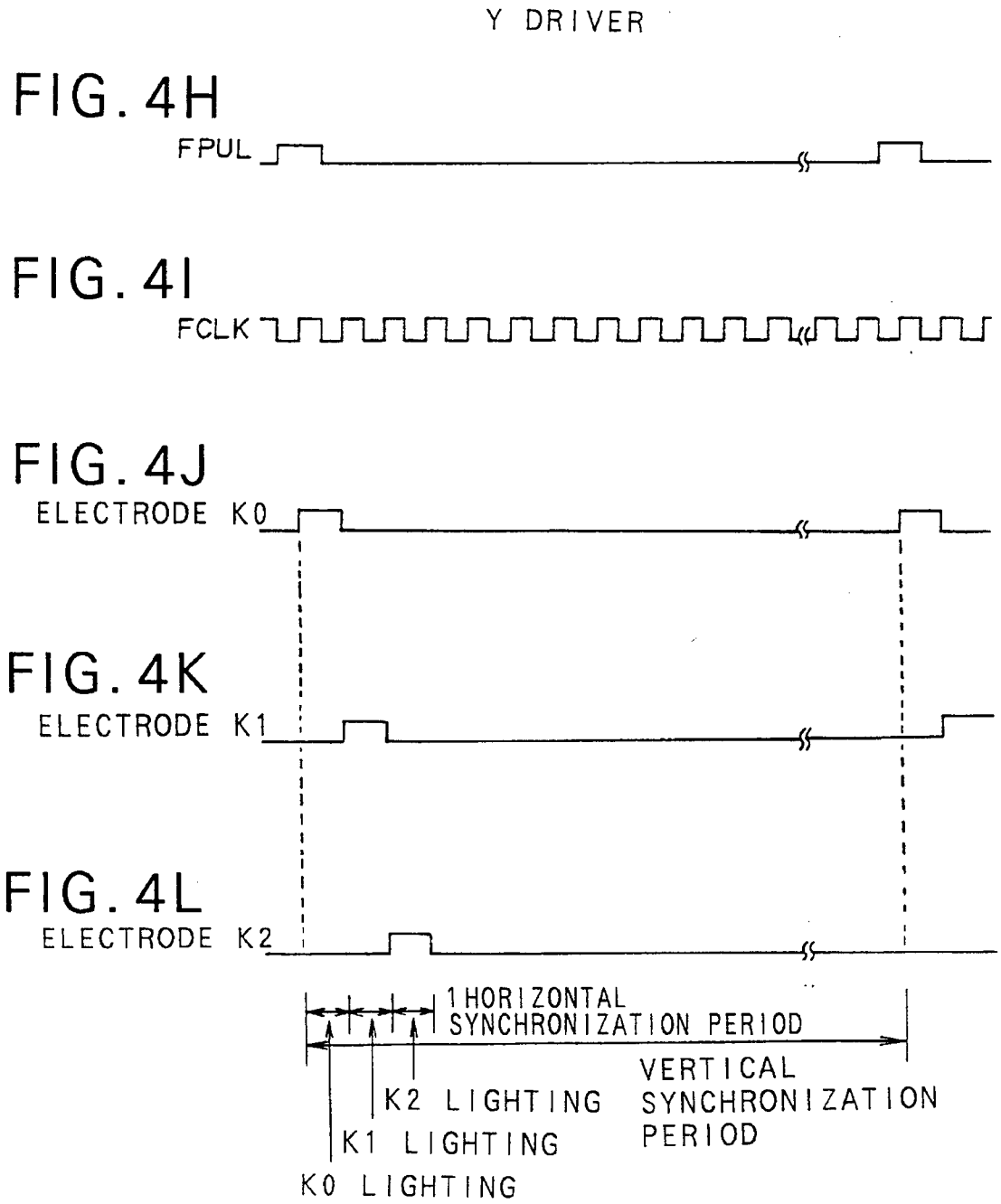

FIG. 3 shows a circuit diagram of the display apparatus.

In FIG. 3, the video signal is supplied to a shift register 38*a* as one example of the memory 38 of FIG. 2, through the A/D convertor 36. The shift register 38*a* includes a plurality of FFs (Flip-Flops) 44. The signals from the FFs 44 in the shift register 38*a* are supplied to PWM (Pulse Width Modulation) modulators 48 through FFs 46 in the X driver 32. The signals (i.e. analog signals showing the pulse widths corresponding to the luminance data) from the PWM modulators 48 are supplied to signal electrodes A0, A1, A2, . . . , while the signals from FFs 50 in the Y driver 34 are supplied to scanning electrodes K0, K1, K2, . . . , respectively. The matrix of the display panel 30 is composed of the signal electrodes A0, A1, A2, . . . and the scanning electrodes K0, K1, K2, . . . , respectively. In the display panel 30, EL elements 52 are connected to the signal electrodes A0, A1, A2, . . . and the scanning electrodes K0, K1, K2, . . . at the intersections of the electrodes A0, A1, A2, . . . and the scanning electrodes K0, K1, K2, . . . , respectively.

A timing generator 42*a* as one example of the controller 42 of FIG. 2, receives a horizontal synchronization signal and a vertical synchronization signal, and outputs a signal SCLK, a signal LCLK, a signal FPUL, and a signal FCLK. The signal SCLK is supplied to the A/D convertor 36 and the FFs 44 in the shift register 38*a*. The signal LCLK is supplied to the FFs 46 in the X driver 32. The signal FPUL and the signal FCLK are supplied to the FFs 50 in the Y driver 34.

The horizontal synchronization signals H are supplied to the PWM modulators 48 in the X driver 32.

FIGS. 4A–4G show timing charts of the X driver and FIGS. 4H–4L show timing charts of the Y driver.

In FIGS. 4A–4G, each time when the video signal is converted by the A/D convertor 36 and sampled, the A/D converted data DATA are sequentially shifted in the FFS 44 in the shift register 38, by the signal SCLK. Then, when all of the data DATA during one horizontal synchronization period, are transmitted to the FFs 44, the data in the FFs 44 are supplied to the PWM modulators 48 through the FFs 46 in the X driver 32, by the signal LCLK. The PWM modulators 48 pulse-width-modulate the received data, and output the pulses, which have the lengths corresponding to the data respectively, to the signal electrodes A0, A1, A2, . . . , respectively.

In FIG. 4H–4L, the signal FPUL is turn to a "High" level once during the vertical synchronization period, and the pulses of the signal FPUL are sequentially transferred to the scanning electrodes (lines) K0, K1, K2, K3, . . . , by the signal FCLK. When the scanning line Kn (n=0, 1, 2, 3, . . . ) is at the "High" level, the line Kn is ignited (i.e. turned to the high level). The signal FCLK outputs one pulse during one horizontal synchronization period. The signal FPUL outputs one pulse during one vertical synchronization period.

Figure 5:
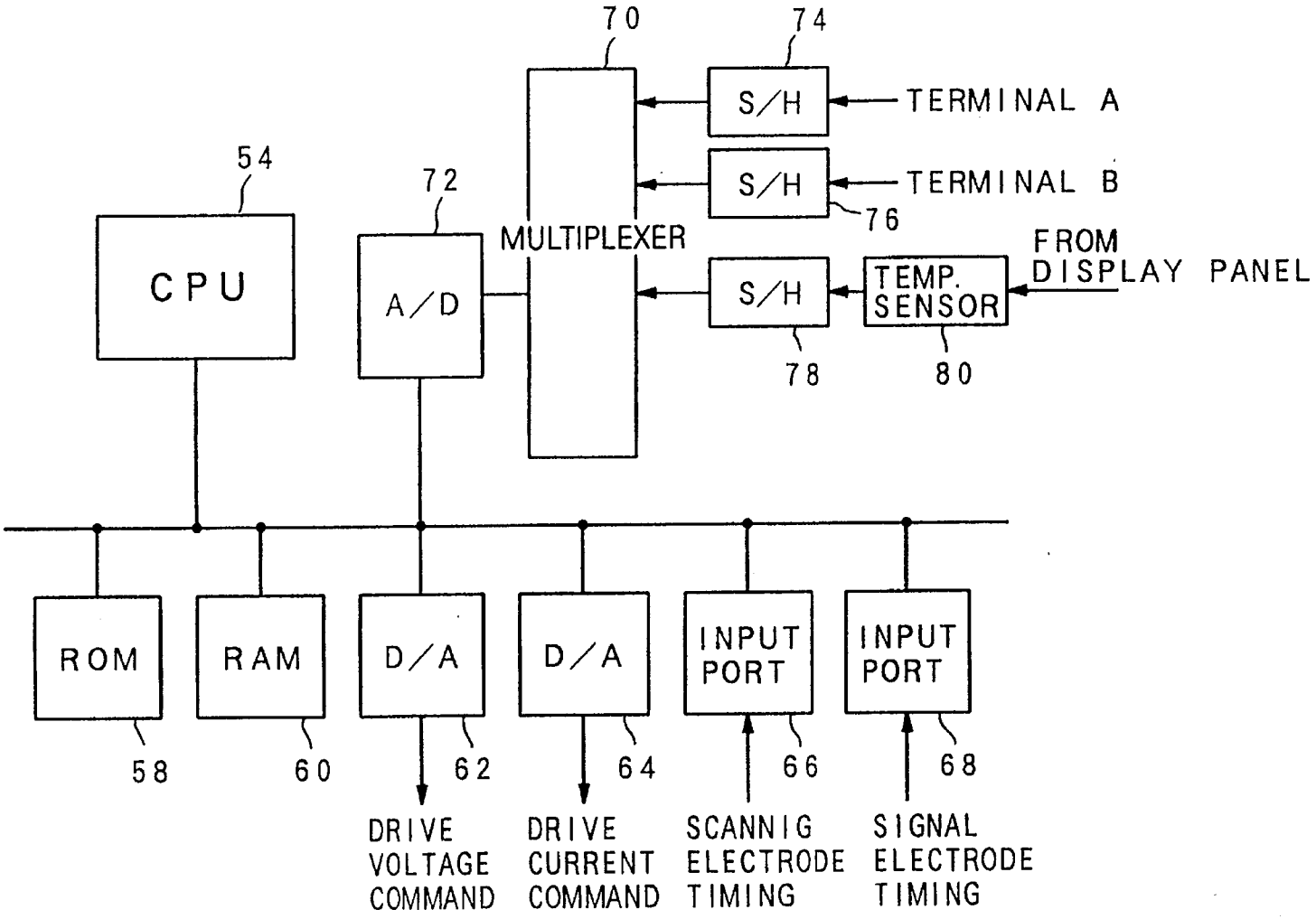
FIG. 5 is a summarized block diagram of the driving circuit for the display apparatus according to the present embodiment.

FIG. 5 shows a summarized construction of the driving circuit of the display apparatus as the present embodiment.

In FIG. 5, the driving circuit is provided with a CPU 54, which is connected to a bus 56. There are also connected to the bus 56, a ROM (Read Only Memory) 58, a RAM (Random Access Memory) 60, D/A convertors 62 and 64, input ports 66 and 68. The D/A convertor 62 and 64 output a driving voltage command and a driving current command, respectively. To the input ports 66 and 68, a scanning electrode (cathode) timing and a signal electrode (anode) timing are supplied.

A multiplexer 70 is connected to the bus 56 through an A/D convertor 72. The multiplexer 70 receives signals from S/H (Sample and Hold) circuits 74, 76 and 78. Here, the S/H circuits 74, 76 and 78 receive the signals respectively from a terminal A, a terminal B and a temperature sensor 80 which will be explained later.

Figure 6:
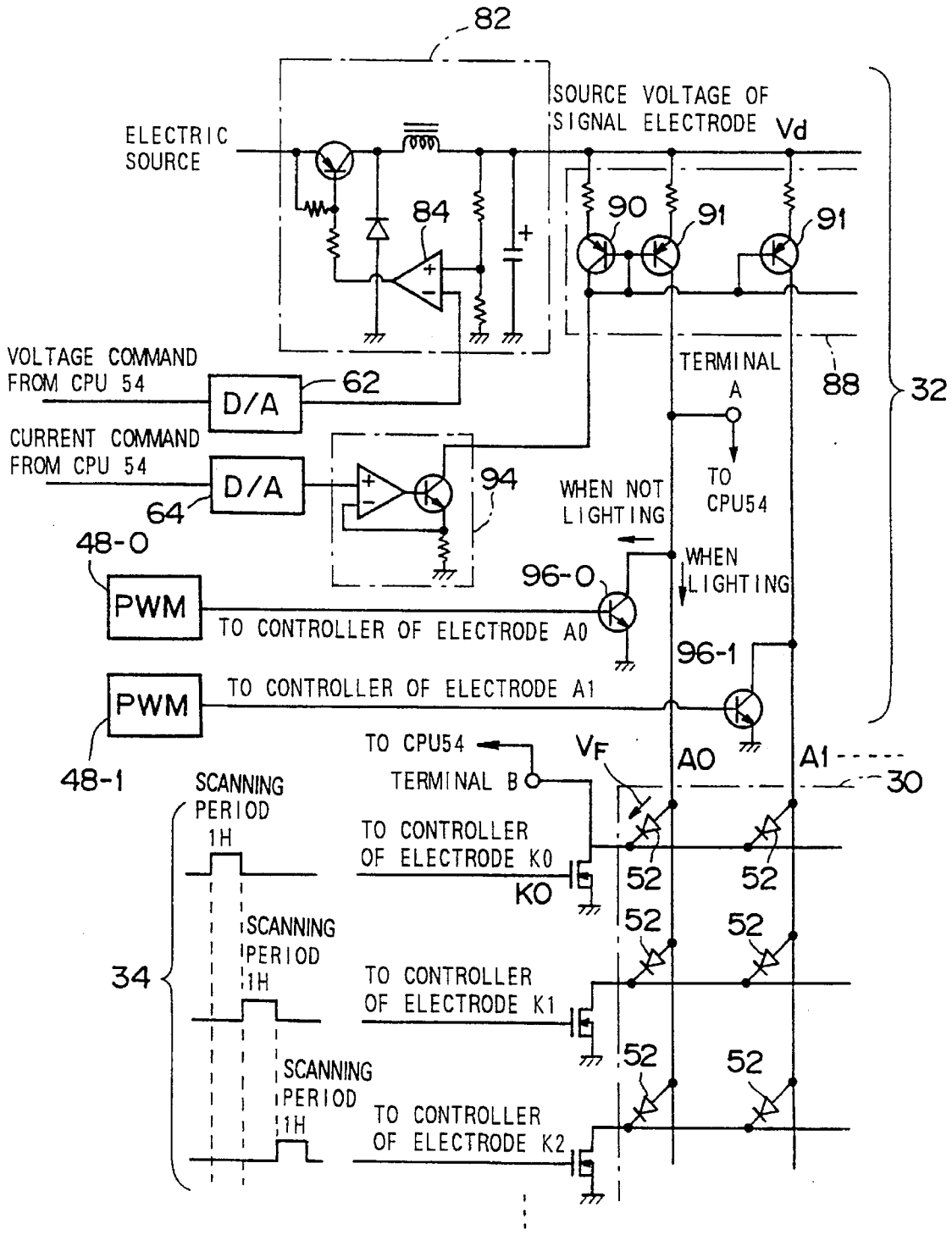
FIG. 6 is a circuit diagram of the driving circuit for the display apparatus in the present embodiment.

Next, FIG. 6 shows a circuit construction of the driving circuit for the display apparatus of the present embodiment.

In FIG. 6, the display panel 30 is driven by the X driver 32 and the Y driver 34. The signal electrodes A0, A1, A2, . . . from the X driver 32 and the scanning electrodes K0, K1, K2, . . . , construct the matrix of the display panel 30. At the intersection portions between the signal electrodes A0, A1, A2, . . . and the scanning electrodes K0, K1, K2, . . . , the EL elements 52 are connected to those electrodes.

First, the Y driver 34 is explained.

In the Y driver 34, when the scanning electrodes K0, K1, K2, . . . are sequentially turned to the "High" level every scanning period (i.e. one horizontal synchronization period), the EL elements 52 connected to the scanning electrodes Kn (n=0, 1, 2, . . . ) which are turned to the "High" level, is turned to light. Here, how much luminance the EL element has in its lighting condition, is determined by the signal of the signal electrodes A0, A1, A2, . . . , from the X driver 32.

Next, the X driver 32 is explained.

An electric source circuit 82 is provided in the driving circuit. In the electric source circuit 82, a voltage command from the CPU 54, is supplied to one terminal of a comparator 84, through the D/A convertor 62.

By controlling the voltage command from the CPU 54, the source voltage Vd for the signal electrode (anode) from the electric source circuit 82, can be controlled.

The source voltage Vd from the electric source circuit 82, is supplied to a constant current source 88. The current command from the CPU 54 is supplied, through the D/A convertor 64 and a V/I (Voltage/current Intensity) convertor 94, to transistors 90, 91, . . . in the constant current source 88. By controlling the current command from the CPU 54, the constant current value from the constant current source 88, can be controlled.

The constant current from the constant current source 88 is supplied to the signal electrodes A0, A1, . . . , which are diverged and connected to connectors of transistors 96-0, 96-1, . . . , respectively. Bases of the transistors 96-0, 96-1, . . . are connected to PWM modulators 48-0, 48-1, . . . , respectively. For example, if the PWM modulator 48-0 is turned to the "High" level, the transistor 96-0 turns to the ON condition, so that the constant current for the signal electrode A0 is flown through the transistor 96-0. Thus, the EL element 52 connected to the signal electrode A0, is in a light out (not lighting) condition. On the other hand, if the PWM modulator 48-0 is at the "low" level, the transistor 96-0 is turn to the OFF condition. Thus, the constant current for the signal electrode A0 is supplied to the EL element 52, so that the EL element 52 is turn to the lighting condition. When the EL element 52 is lighting, the luminance of the EL element 52 is determined by the time duration required for the PWM modulator 48 to turn to the "low" level.

In order to detect the voltage drop Vf of the EL element 52, a detection terminal A is installed to the signal electrode A0, and a detection terminal B is installed to the scanning electrode K0. The detection signals from the detection terminals A and B are supplied to the CPU 54. In the CPU 54, the voltage drop Vf of the EL element 52 is obtained on the basis of the detection signals from the detection terminals A and B. Then, the CPU 54 outputs the voltage command, on the basis of the obtained voltage drop Vf. This voltage command is, as aforementioned, supplied to one terminal of the comparator 84 in the electric source circuit 82 through the D/A convertor 62. Consequently, the source voltage Vd from the electric source circuit 82, can be controlled to be an appropriate value.

The procedure for controlling the source voltage Vd, will be explained hereinbelow, with referring to a flow chart of FIG. 7.

When the procedure starts (step S100), the driving current value is set (step S102). Namely, the luminance is set. Then, the EL element, which voltage drop is to be detected, is selected, and it is checked whether the scanning electrode (cathode) becomes active or not (step S104). When the scanning electrode (cathode) becomes active in the step S104 (YES), the flow branches to a step S106. In the step S106, the EL element to be measured is driven, and it is checked whether the signal electrode (anode) becomes active or not. When the signal electrode becomes active in the step S106 (YES), the flow branches to the step S108.

In the step S108, the voltage difference Vx between the detection terminal A and the GND, or between the detection terminals A and B, is measured. Then, the voltage drop ΔV at the anode and the cathode is estimated from the driving current value, and the resistance values of the signal electrodes (anode) and the scanning electrodes (cathode). The estimated voltage drop ΔV is subtracted from the voltage difference Vx to obtain the voltage drop Vf of the EL element (step S110). Then, the driving voltage Vd at the minimum limit necessary for driving the EL element, is estimated from the obtained voltage drop Vf and the current value set beforehand (step S112).

In the steps S108 and S110, in short, the voltage difference between the voltage at the portion, where the voltage is increased in the highest degree, and the voltage at the electric source, is obtained.

Then, it is checked whether the maximum value of the driving voltage Vd able to be set, is greater than the estimated driving voltage Vd or not (step S114). If the maximum value able to be set is greater than the estimated value in the step S114 (YES), the flow branches to a step S116, where the driving voltage is set to the estimated value Vd. On the other hand, if the maximum value able to be set is not greater than the estimated value at the step S114 (NO), the flow branches to a step S118, where a message to indicate the life end of the display panel, is displayed, and the operation is ended (step S120).

Figure 7:
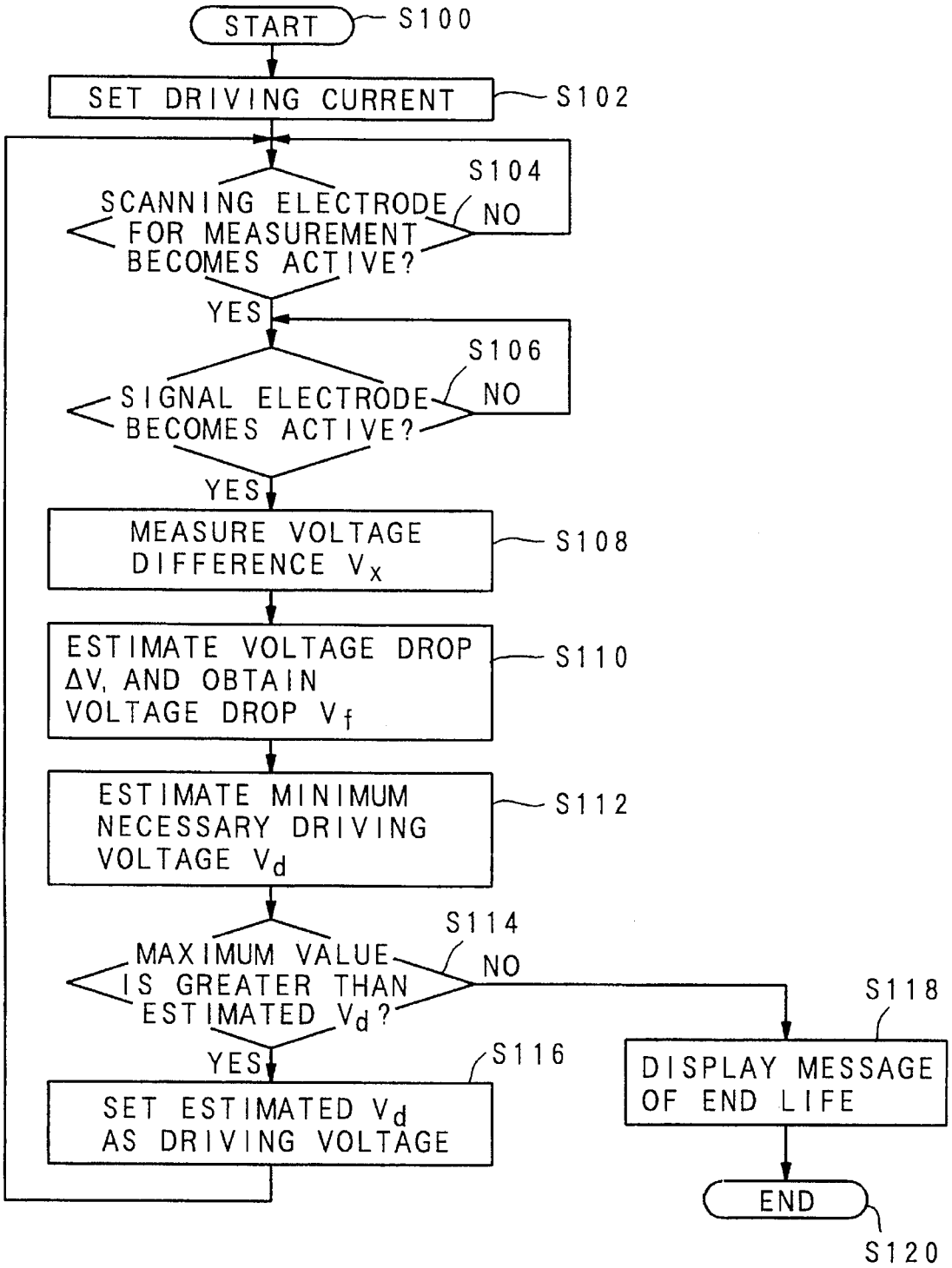
FIG. 7 is a flow chart of one operation of the driving circuit of the present embodiment.
Figure 8:
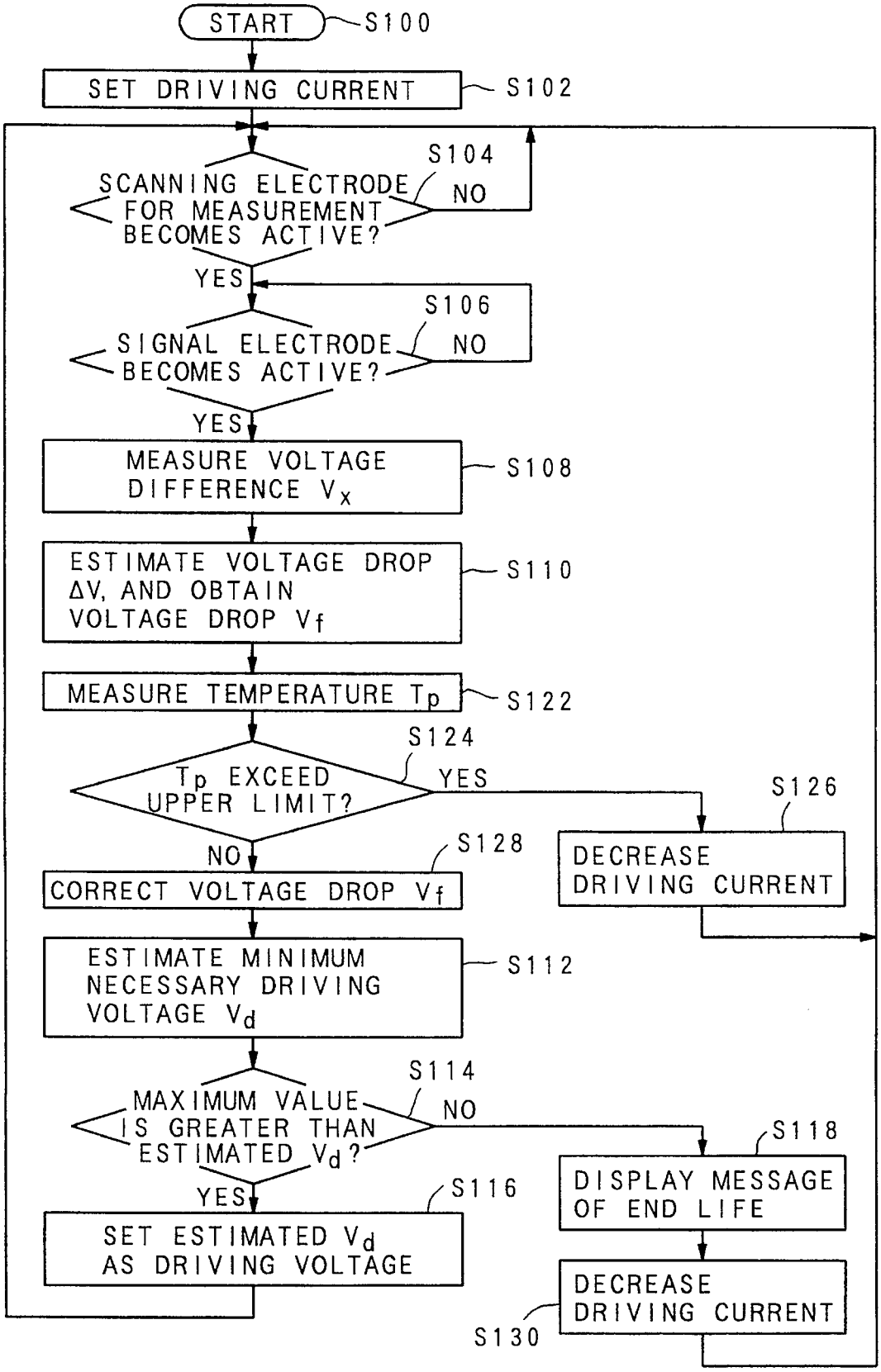
FIG. 8 is a flow chart of another operation of the driving circuit of the present embodiment.

Next, FIG. 8 shows a modified example of the flow chart of FIG. 7.

In FIG. 8, the steps from S100 to S110, are the same as those in FIG. 7, and the explanations thereof are omitted. From the step S110, the flow goes to a step S122, where the temperature of the display panel Tp is measured by a temperature sensor 80 of FIG. 5. Then, it is checked whether the temperature Tp of the display panel exceeds the upper limit temperature or not (step S124). If the temperature Tp exceeds at the step S124 (YES), the flow branches to a step S126, where the driving current value is decreased. On the other hand, if the temperature Tp does not exceed at the step S124 (NO), the flow branches to a step S128, where the voltage drop Vf of the EL element is corrected on the basis of the temperature Tp of the display panel. After that, the flow proceeds to the steps S112, S114 and S116, which are the same as those in the aforementioned flow chart of FIG. 7. If it is NO at the step S114, a message is displayed which indicates the life end of the display panel (step S118). Then, the driving current value is decreased. Namely, the luminance is decreased (step S130).

Figure 9A:
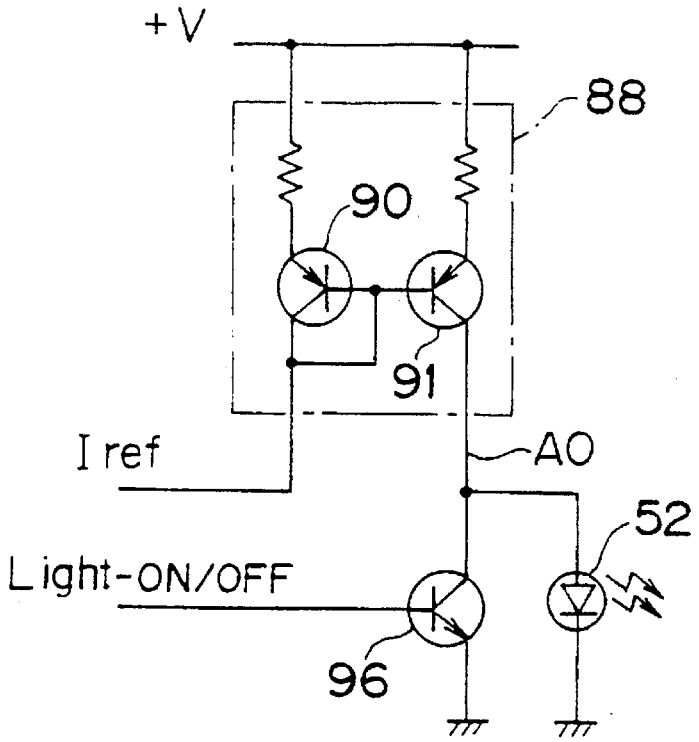
FIG. 9A is a circuit diagram of one example of a constant current driving circuit of the present embodiment.
Figure 9B:
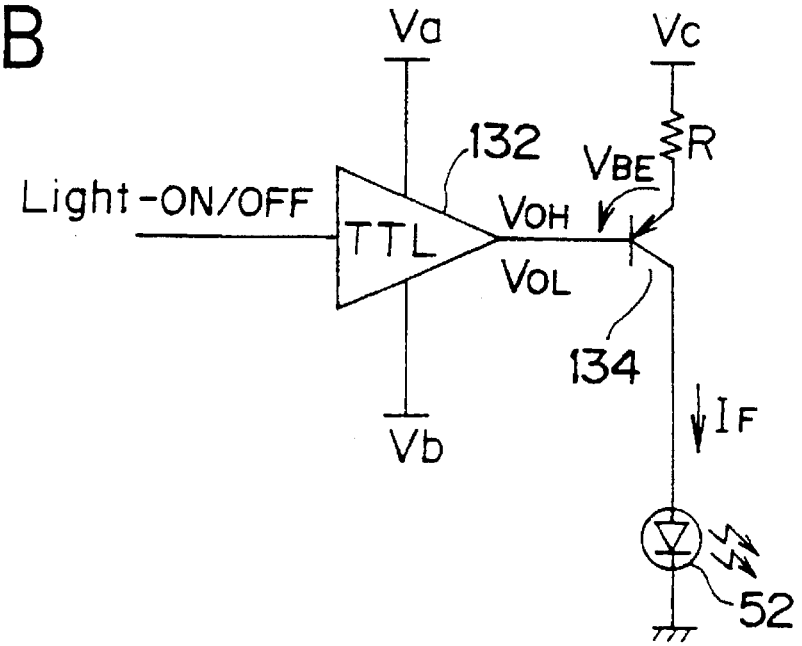
FIG. 9B is a circuit diagram of another example of a constant current driving circuit of the present embodiment.

FIGS. 9A and 9B show two examples of the constant current driving circuit.

Namely, in FIG. 9A, the source voltage +V is supplied to the constant current source 88 having a current mirror construction. The standard current Iref is supplied to the transistors 90 and 91 in the constant current source 88. The constant current from the constant current source 88 is supplied to the EL element 52 through the signal electrode A0. The signal electrode A0 is diverged and connected to the collector of the transistor 96. The ON/OFF signal for luminance is supplied to the base of the transistor 96.

Then, if the ON/OFF signal for luminance, is at the "High" level, the transistor 96 is in the ON condition. Thus, the constant current of the signal electrodes A0 is flown through the transistor 96, so that the EL element 52 is in the light out (not lighting) condition. On the other hand, if the ON/OFF signal is at the "low" level, the transistor 96 turns to the OFF condition. Thus, the constant current of the signal electrode A0 is supplied to the EL element 52, so that the EL element 52 is in the lighting condition.

In FIG. 9B, the output from a TTL (Transistor Transistor Logic) 132 becomes $V_{OH}$ or $V_{OL}$ depending on the ON/OFF signal for luminance. By this, the transistor 134 becomes in the ON condition or the OFF condition. As a result, the constant current If from the transistor 134, is supplied or not supplied to the EL element 52. Here, the constant current If is expressed by a following expression, when the transistor 134 is in the ON condition.

$$If=(Vc-V_{OL}+V_{BE})/R$$

As described above in detail, according to the present embodiment, the driving circuit for the display apparatus is constructed such that the voltage drop at the EL element is measured, and the predetermined voltage is supplied to the driving device in correspondence with the measured voltage drop. Accordingly, if the voltage drop of the EL element becomes large because of the long time usage of the EL element, the high voltage is supplied to the driving device, so that the appropriate lighting condition of the EL element can be maintained. On the other hand, in the initial condition in which the ability of the EL element is not degraded, since the voltage drop of the EL element is small, the low voltage is supplied to the driving device. As a result, the consumption power at the driving circuit can be reduced.

Figure 10:
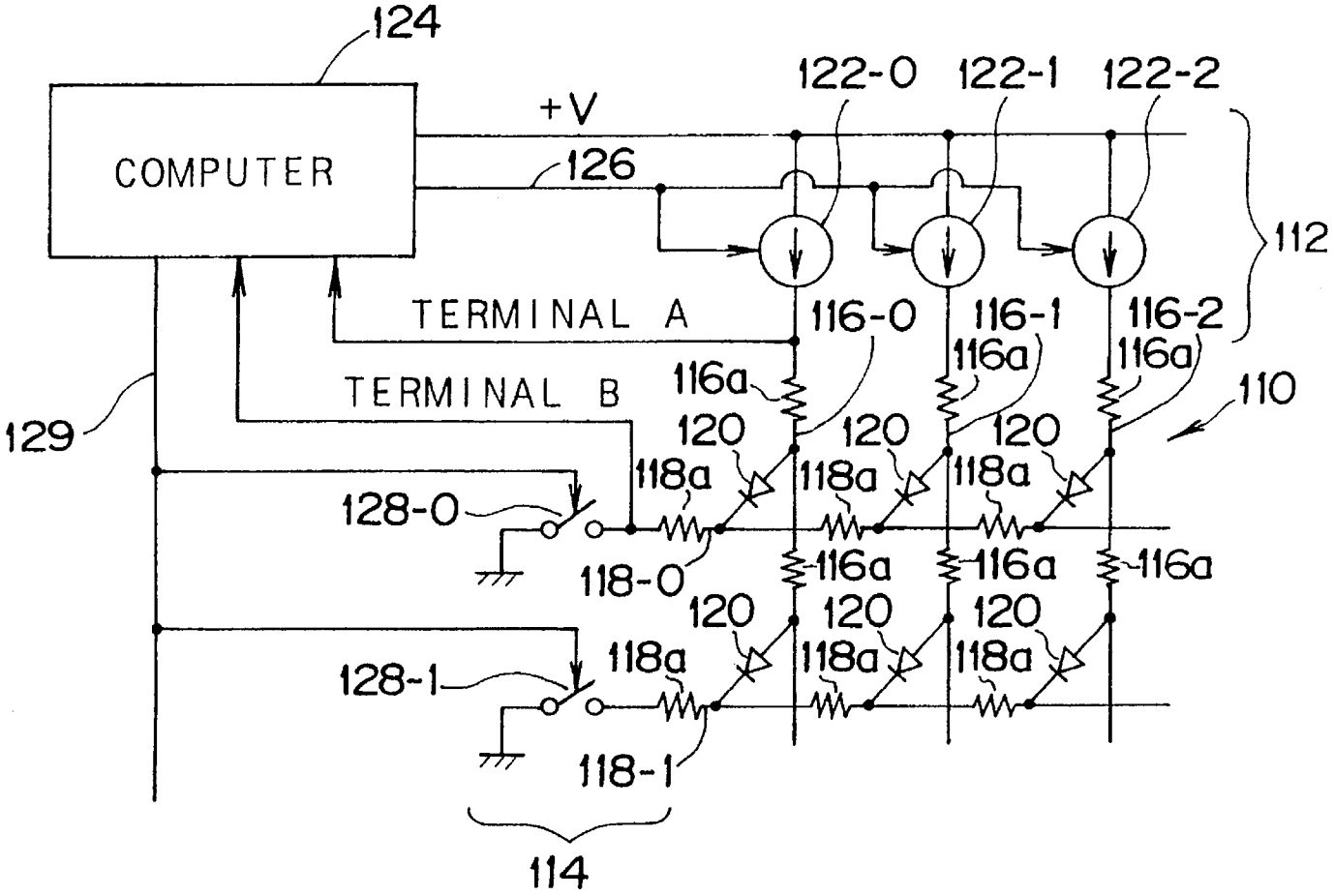
FIG. 10 is a circuit diagram of a driving circuit for a display apparatus, as another embodiment of the present invention.

FIG. 10 shows another embodiment of the present invention, which is a driving circuit for the display apparatus of simple matrix (constant current driving) type.

In FIG. 10, a display panel 110 is driven by a X driver 112 and a Y driver 114. The matrix of the display panel 110 is constructed by signal electrodes 116-0, 116-1, 116-2, . . . from the X driver 112 and scanning electrodes 118-0, 118-1, . . . from the Y driver 114. In the display panel 110, EL elements 120 are connected to those signal electrodes and the scanning electrodes at the intersections of those signal electrodes and the scanning electrodes.

The X driver 112 includes constant current sources 122-0, 122-1, 122-2, . . . , and receives PWM modulating signal 126 and the source voltage (+V) from a control computer 124. The X driver 112 outputs a constant current to turn on the EL elements, to the signal electrodes 116-0, 116-1, 116-2, . . . , respectively. The Y driver 114 includes switch elements 128-0, 128-1 ,. . . , which perform ON/OFF operations according to the control signal 129 from the control computer 124, so as to connect and disconnect the scanning electrodes 118-0, 118-1, . . . to the ground GND.

The anode of the EL element 120 is connected to the signal electrodes 116-0, 116-1, 116-2, . . . , and the cathode of the EL element 120 is connected to the scanning electrodes 118-0, 118-1, . . . , respectively. The reference numerals **116*a* represent resistance of the signal electrode 116, 118*a* represent the resistance of the scanning electrode 118**.

In order to measure the degradation in ability of the EL element 120, voltage detection terminals A and B are installed to the signal electrode 116-0 and the scanning electrode 118-0. When the EL element 120 which is connected to the intersection of the signal electrode 116-0 and the scanning electrode 118-0, is turned to light, the voltage difference between the detection terminals A and B, is measured. Then, the voltage drop of the lines (i.e. the resistance **116*a*, 118*a*) is subtracted from the measured voltage difference, to estimate the forward direction voltage drop Vf of the EL element 120. Since there is a mutual relationship between the luminance degradation of the EL element 120 and the voltage drop Vf, the degradation of the EL element can be estimated on the basis of the change in the voltage drop Vf. The degradation of the luminance is compensated by increasing the current value from the constant current source 122**.

In addition, when the value of the voltage drop Vf is measured, the detection terminal, which error becomes the smallest, is the terminal where the voltage drop due to the lines is the smallest. Namely, in the construction of FIG. 10, the detection terminals A and B are such terminals which can measure the forward direction voltage drop Vf when the EL element 120 on the left side is driven. However, the voltage drop of the EL element 120 can be estimated by measuring any other detection terminal. Further, by constructing another EL element exclusive for the voltage drop detection, beside the display picture plane, and by measuring the EL element exclusive for the detection, the same procedure can be performed.

The construction of the driving circuit of the present embodiment in FIG. 10, and the construction of the display apparatus including the driving circuit are the same as those explained in FIGS. 2 to 6, and the explanations thereof are omitted.

The characteristic feature of the present embodiment is as following. Namely, in FIG. 6, when the voltage drop Vf of the EL element 52 is obtained in the CPU 54, the CPU 54 outputs the current command on the basis of the obtained voltage drop Vf. This current command is, as aforementioned, supplied to the transistors 90 and 91, in the constant current source 88, through the D/A convertor 64 and the V/I convertor 94. Consequently, the constant current from the constant current source 88, can be controlled to be an appropriate current value.

Nextly, the procedure to control the current value from the constant current source according to the present embodiment, will be explained with referring to a flow chart of FIG. 11.

Figure 11:
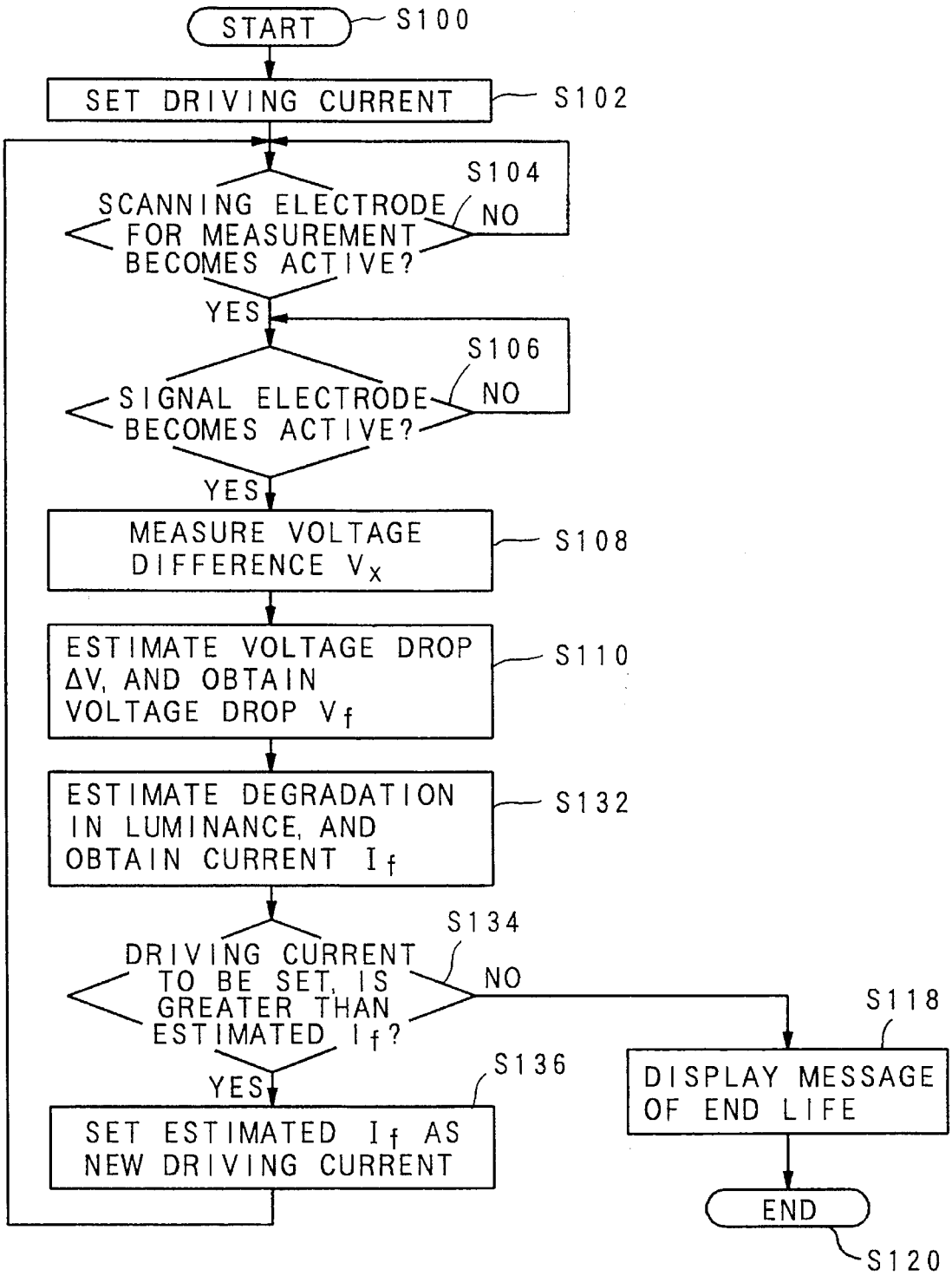
FIG. 11 is a flow chart of one operation of the driving circuit of the present embodiment of FIG. 10.

In FIG. 11, the steps from S100 to S110, are the same as those in FIG.7, and the explanations thereof are omitted. From the step S110, the flow goes to a step S132, where the degree of the degradation in luminance of the EL element is estimated from the obtained voltage drop value Vf, and the current value If to keep the luminance constant is obtained.

Since the voltage drop Vf cannot be directly measured because of the construction of the EL element, the steps S108 and S110 are performed in the present embodiment.

Then, it is checked whether the maximum driving current value which can be set in the driving circuit, is greater than the estimated current value If or not (step S134). If the driving current value to be set is greater than the estimated If value in the step S134 (YES), the flow branches to the step S136, where the estimated If value is set as the new driving current value. On the other hand, if the driving current value to be set is not greater than the estimated If in the step S134 (NO), the flow branches to the step S118, where the message indicating the life end of the EL element, is displayed.

Figure 12:
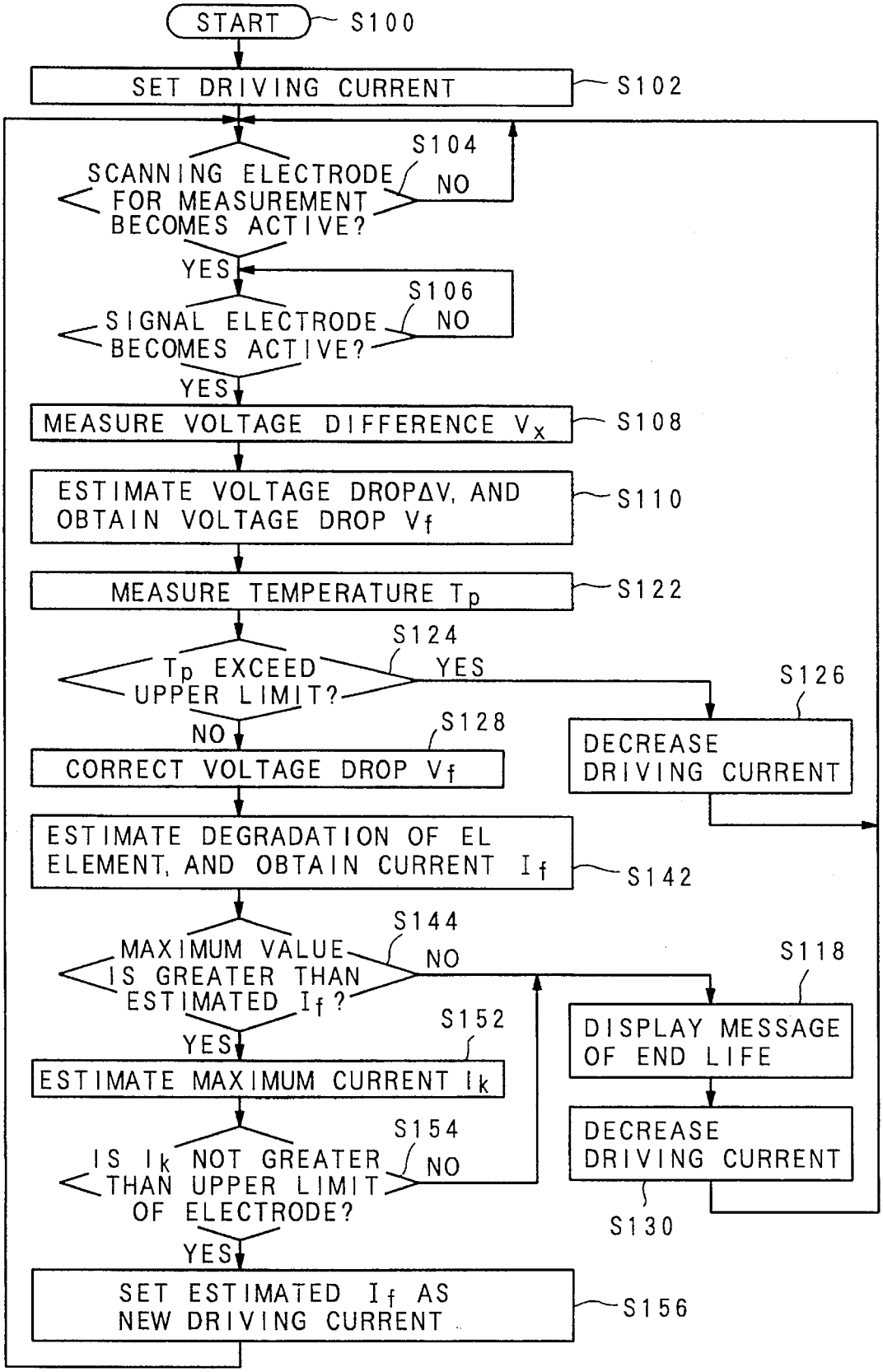
FIG. 12 is a flow chart of another operation of the driving circuit of the present embodiment of FIG. 10.

Nextly, FIG. 12 shows a modified example of the flow chart of FIG. 11.

In FIG. 12, the steps from S100 to S110, S118, and S122 to S130, are the same as those in FIG. 8, and the explanations thereof are omitted. From the step S128, the flow goes to a step S142, where the degree of the degradation in luminance of the EL element is estimated from the obtained voltage drop value Vf, and the current value If to keep the luminance constant is obtained.

Then, it is checked whether the maximum driving current value which can be set in the driving circuit, is greater than the estimated current value If or not (step S144). If the maximum driving current value is not greater than estimated current If in the step S144 (NO), the flow branches to the step S118.

On the other hand, if the maximum driving current value is greater than the estimated value If in the step S144 (YES), the flow branches to a step S152, where the maximum current Ik of the scanning electrode is estimated. Then, it is checked whether the value of the estimated maximum current Ik is below the upper limit value of the scanning electrode or not (step S154). If it is below the upper limit in the step S154 (YES), the flow branches to a step S156, where the estimated If value is set as the new driving current value. If it is not below the upper limit in the step S154 (NO), the flow branches to the step S118.

The construction of the constant current driving circuit used in the present embodiment of FIG. 10, is the same as the aforementioned constructions of FIG. 9, and the explanations thereof are omitted.

According to the present embodiment, the driving device is constructed such that the voltage drop of the EL element is measured, and the current from the driving device is controlled in correspondence with the measured voltage drop. Namely, if the luminance characteristic versus current of the EL element is degraded by the long time usage of the EL element, the current from the driving device is increased so that the luminance of the EL element can be kept constant. On the other hand, in the initial condition where the ability of the EL element is not degraded, the current from the driving device is decreased, resulting in that the consumption power at the driving device can be decreased.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. A driving circuit for a display apparatus having a display panel, which comprises a plurality of scanning electrodes and a plurality of signal electrodes arranged in a matrix shape, and a plurality of EL (Electroluminescence) elements connected to the scanning electrodes and the signal electrodes at intersections thereof, said driving circuit comprising:

a driving means for supplying a constant current driving signal to said signal electrodes in correspondence with an input signal, to drive said display panel;

a detection means for detecting a voltage drop in a forward direction of the EL element, and outputting a detection signal which indicates the detected voltage drop;

a control means for controlling voltage, which is supplied to said driving means, to have a predetermined voltage value for maintaining said driving means with respect to said EL elements in an initial usage condition and controlling the voltage to have an increased voltage value larger than the predetermined voltage value for compensating a voltage drop component of said EL elements due to degradation of said EL elements with respect to said EL elements in a used condition, in correspondence with the detection signal from said detection means; and a temperature detection means for detecting a temperature of said display panel, said control means correcting the detected voltage drop of the detection signal on the basis of the detected temperature.

2. A driving circuit according to claim 1, wherein said control means checks whether the detected temperature exceeds an upper limit temperature of said display panel or not, and controls said driving means to decrease the current value of the constant current driving signal if the detected temperature exceeds the upper limit.

3. A driving circuit according to claim 1, wherein a detection terminal is installed to at least one of the signal electrodes and the scanning electrodes, where the voltage drop is detected by said detection means.

4. A driving circuit according to claim 3 wherein said detection terminal is installed to at least one of the signal electrode and the scanning electrode corresponding to a central portion of a picture plane of said display panel.

5. A driving circuit according to claim 1, wherein said control means controls the voltage to have a low voltage value when the detection means detects a small voltage drop, and controls the voltage to have a high voltage value when the detection means detects a large voltage drop.

6. A driving circuit for a display apparatus having a display panel, which comprises a plurality of scanning electrodes and a plurality of signal electrodes arranged in a matrix shape, and a plurality of EL (Electroluminescence) elements connected to the scanning electrodes and the signal electrodes at intersections thereof, said driving circuit comprising:

a driving means for supplying a constant current driving signal to said signal electrodes in correspondence with an input signal, to drive said display panel;

a detection means for detecting a voltage drop in a forward direction of the EL element, and outputting a detection signal which indicates the detected voltage drop;

a control means for controlling the constant current driving signal, which is supplied from said driving means, to have a predetermined current value for maintaining said EL elements with respect to said EL elements in an initial usage condition and controlling the constant current driving signal to have an increased current value larger than the predetermined current value for keeping the luminance of said EL elements constant by compensating a voltage drop component of said EL elements due to degradation of said EL elements with respect to said EL elements in a used condition, in correspondence with the detection signal from said detection means; and a temperature detection means for detecting a temperature of said display panel, said control means correcting the detected voltage drop of the detection signal on the basis of the detected temperature.

7. A driving circuit according to claim 6, wherein said control means checks whether the detected temperature exceeds an upper limit temperature of said display panel or not, and controls said driving means to decrease the current value of the constant current driving signal if the detected temperature exceeds the upper limit.

8. A driving circuit according to claim 6, wherein a detection terminal is installed to at least one of the signal electrodes and the scanning electrodes, where the voltage drop is detected by said detection means.

9. A driving circuit according to claim 8 wherein said detection terminal is installed to at least one of the signal electrode and the scanning electrode corresponding to a central portion of a picture plane of said display panel.

10. A driving circuit according to claim 6, wherein said control means controls the constant current driving signal to have a low current value when the detection means detects a small voltage drop, and controls the constant current driving signal to have a high current value when the detection means detects a large voltage drop.

11. A method of driving a display apparatus having a display panel, which comprises a plurality of scanning electrodes and a plurality of signal electrodes arranged in a matrix shape, and a plurality of EL (Electroluminescence) elements connected to the scanning electrodes and the signal electrodes at intersections thereof, said method comprising the steps of:

supplying a constant current driving signal to said signal electrodes in correspondence with an input signal, to drive said display panel by a driving device;

detecting a voltage drop in a forward direction of the EL element, and outputting a detection signal which indicates the detected voltage drop;

controlling voltage, which is supplied to said driving device, to have a predetermined voltage value for maintaining said driving device with respect to said EL elements in an initial usage condition and controlling the voltage to have an increased voltage value larger than the predetermined voltage value for compensating a voltage drop component of said EL elements due to degradation of said EL elements with respect to said EL elements in a used condition, in correspondence with the detection signal;

detecting a temperature of said display panel; and correcting the detected voltage drop of the detection signal on the basis of the detected temperature.

12. A method according to claim 11, wherein, in the controlling step, it is checks whether the detected temperature exceeds an upper limit temperature of said display panel or not, and the current value of the constant current driving signal is decreased if the detected temperature exceeds the upper limit.

13. A method according to claim 11, wherein, in the controlling step, the voltage is controlled to have a low voltage value when a small voltage drop is detected in the detecting step, and the voltage is controlled to have a high voltage value when a large voltage drop is detected in the detecting step.

14. A method of driving a display apparatus having a display panel, which comprises a plurality of scanning electrodes and a plurality of signal electrodes arranged in a matrix shape, and a plurality of EL (Electroluminescence) elements connected to the scanning electrodes and the signal electrodes at intersections thereof, said method comprising the steps of:

supplying a constant current driving signal to said signal electrodes in correspondence with an input signal, to drive said display panel;

detecting a voltage drop in a forward direction of the EL element, and outputting a detection signal which indicates the detected voltage drop;

controlling the constant current driving signal to have a predetermined current value for maintaining said EL elements with respect to said EL elements in an initial usage condition and controlling the constant current driving signal to have an increased current value larger than the predetermined current value for keeping the luminance of said EL elements constant by compensating a voltage drop component of said EL elements due to degradation of said EL elements with respect to said EL elements in a used condition, in correspondence with the detection signal;

detecting a temperature of said display panel; and correcting the detected voltage drop of the detection signal on the basis of the detected temperature.

15. A method according to claim 14, wherein, in the controlling step, it is checks whether the detected temperature exceeds an upper limit temperature of said display panel or not, and the current value of the constant current driving signal is decreased if the detected temperature exceeds the upper limit.

16. A method according to claim 14, wherein, in the controlling step, the constant current driving signal is controlled to have a low current value when a small voltage drop is detected in the detecting step, and the constant current driving signal is controlled to have a high current value when a large voltage drop is detected in the detecting step.

* * * * *